United States Patent [19]

Soworowski

[11] 4,258,241

[45] Mar. 24, 1981

[54] SLOT FURNACE FOR INDUCTIVELY HEATING AXIALLY SPACED AREAS OF A WORKPIECE

[75] Inventor: David R. Soworowski, Boaz, Ala.

[73] Assignee: Park-Ohio Industries, Inc., Cleveland, Ohio

[21] Appl. No.: 24,702

[22] Filed: Mar. 28, 1979

[51] Int. Cl.[3] ..... H05B 6/40

[52] U.S. Cl. ..... 219/10.71; 219/10.79; 219/10.43; 266/129

[58] Field of Search ..... 219/10.79, 10.71, 10.69, 219/10.67, 10.75, 10.57, 9.5, 8.5, 10.61, 10.43; 13/26; 336/115, 116, 121; 266/129; 148/145

[56] References Cited

U.S. PATENT DOCUMENTS

| | | | |
|---|---|---|---|
| 2,452,197 | 10/1948 | Kennedy | 219/10.79 X |
| 2,667,524 | 1/1954 | Dreyfus et al. | 13/26 |
| 2,905,798 | 9/1959 | Freutel | 219/10.79 |
| 3,444,346 | 5/1969 | Russell et al. | 219/10.79 |
| 3,446,930 | 5/1969 | Seulen et al. | 219/10.69 |
| 3,467,806 | 9/1969 | Dixon | 219/10.79 |
| 3,485,983 | 12/1969 | Tama et al. | 219/10.69 |
| 3,619,540 | 11/1971 | Soworowski | 219/10.71 |
| 3,705,285 | 12/1972 | Cachat | 219/10.69 |
| 3,725,629 | 4/1973 | Vickers | 219/10.69 X |
| 4,122,321 | 10/1978 | Cachat | 219/10.71 |

FOREIGN PATENT DOCUMENTS

| | | | |
|---|---|---|---|
| 2372402 | 7/1978 | France | 219/10.69 |
| 1513241 | 6/1978 | United Kingdom | 219/10.79 |

*Primary Examiner*—Elliot A. Goldberg
*Assistant Examiner*—Philip H. Leung
*Attorney, Agent, or Firm*—Meyer, Tilberry & Body

[57] ABSTRACT

An induction heating inductor is provided for use in a slot type of furnace to heat axially spaced portions of an elongated workpiece. This inductor includes first and second generally rigid, elongated input members normally fixed with respect to each other and extending generally parallel to the workpiece and a conductor unit extending between the input members to define one of the heating portions and adjustable for changing the position of this heating portion on the workpiece.

8 Claims, 5 Drawing Figures

SLOT FURNACE FOR INDUCTIVELY HEATING AXIALLY SPACED AREAS OF A WORKPIECE

The present invention relates to the art of induction heating and more particularly to an induction heating inductor assembly for use in a slot type of furnace to heat one or more axially spaced portions of an elongated workpiece.

The invention is particularly applicable for heating two or more axially spaced portions on the end of an elongated workpiece, such as a center link shaft, and it will be described with particular reference thereto; however, it is appreciated that the invention has much broader applications and may be used for heating a single portion or a plurality of portions of various elongated workpieces.

BACKGROUND OF THE INVENTION

In many instances, an elongated workpiece such as a center link shaft must be heated at axially spaced positions, for a successive forming operation. This is often done by passing the shaft axially through a solenoid type of inductor or coil. As the workpiece moves axially with respect to the inductor or coil, the coil is energized when aligned with the areas to be inductively heated. This process has proven quite satisfactory; however, each workpiece must be loaded, unloaded and processed individually. This requires a substantial amount of time and requires a heating cycle dependent upon the amount of movement of the workpiece together with the necessary time for heating the spaced portions of the workpiece to the desired forming temperature. To overcome this difficulty, it has been suggested that the workpieces could be moved transversely along a feedline between spaced inductors generally of a fixed design and aligned with the portions of the workpiece to be heated. This arrangement has not proven too satisfactory because the inductors are quite expensive and can be used for only a particular workpiece. For that reason, such an arrangement would be applicable only for high production. Also, the control of the band width for the heated portions of the workpiece is difficult.

THE INVENTION

The present invention relates to a slot type of furnace employing an inductor for heating axially spaced portions of an elongated workpiece which overcomes the disadvantages set forth above and others which will be apparent after considering the preferred embodiment of the invention.

In accordance with the present invention there is provided an inductor for use in a slot type of furnace. A slot type of furnace is a furnace which has an elongated opening through which elongated workpieces are passed laterally from an entrant end to an exit end similar to a solenoid type of heating coil. In accordance with the invention, the inductor assembly includes first and second generally rigid, elongated input members normally fixed with respect to each other and extending generally parallel to the axis of the workpiece being moved through the furnace. Means are provided for connecting the input members across a source of alternating current, a first conductor means electrically connected between the input members for inductively heating the first portion of the workpiece and a second inductor means electrically connected between the input members for inductively heating the second portion of the workpiece. In this inductor, there is also provided means for selectively changing the axial spacing between the first and second conductor means. By using an inductor assembly of this type, the spaced conductor means, which are connected in electrical parallel with respect to each other, can be positioned for alignment with portions of the workpiece which are to be heated preparatory to forming. A conveyor is used for conveying the workpieces transversely through the slot of the slot furnace. In the preferred embodiment, two of the inductor assemblies described above are provided at each end of the workpiece. In this manner, both ends of a workpiece can be processed by an inductor assembly constructed in accordance with the present invention. Although the preferred embodiment employs two spaced adjustable conductor units for defining the position of a heating area, it is possible to employ a single unit which is adjustable to selectively heat a particular workpiece area. In this manner, to adjust the heated area of the workpiece it is only necessary to adjust the position of the conductor unit or units and not the rigid frame used to support the units and used to direct an alternating current through the conductor units. A fixed frame can thus be used to define the slot of the furnace and individual conductor units can be adjustably positioned within the slot of the furnace. This then determines the portions of the workpiece which are to be heated.

In accordance with another aspect of the invention wherein as few as one set of inductor units is employed, there is provided an induction heating inductor for heating an area of an elongated workpiece having an axis and moving in a feedline transverse to the axis. This inductor comprises two input leads, a first elongated conductor unit, a second elongated conductor unit, a fixed frame means for supporting the units in parallel relationship and extending parallel to the feedline and on opposite sides thereof, means for adjusting the conductor units on the fixed frame means in a direction transverse to the feedline, means for clamping the units in an adjusted position with respect to the frame means and means for connecting the conductor units in electrical series with the two input leads. In accordance with another aspect of the invention, there is provided the subassembly forming one portion of the conductor units as defined above. In accordance with this aspect of the invention, there is provided a rigid conductor unit for use in a slot type of induction heating furnace, which unit includes first and second spaced ends adpated to be connected across a source of alternating current, a first current distributing element adjacent the first end, a second current distributing element adjacent the second end, a plurality of rigid electrically and physically parallel conductors extending between the first and second elements and a portion of a slidable coupling on each of the current distributing elements. In this manner, the inductor unit can produce a relatively wide heating pattern which is positively distributed by the parallel conductors.

The primary object of the present invention is the provision of an inductor assembly for use as a slot furnace to heat an axial portion of an elongated workpiece, which assembly is supported on a generally fixed frame and is adjustable to accommodate different axial positions of the heated area.

Another object of the present invention is the provision of more than one inductor assembly, as defined above, which assemblies are mounted on the same frame and adjustable with respect to each other in an axial direction with respect to the workpiece.

Another object of the present invention is the provision of an inductor assembly of the type described above, which assembly includes an inductor unit having a group of parallel conductors to control the width of the heating pattern on the workpiece.

Still a further object of the present invention is the provision of an inductor assembly of the type described above, which assembly can be employed with a fixed receiving frame to adjust the number, positions and widths of various heating portions or bands on a elongated workpiece as it passes through a slot furnace.

These and other objects and advantages will become apparent from the following description.

BRIEF DESCRIPTION OF DRAWINGS

To illustrate the preferred embodiment of the invention, the following drawings are employed.

PREFERRED EMBODIMENT

Figure 1:
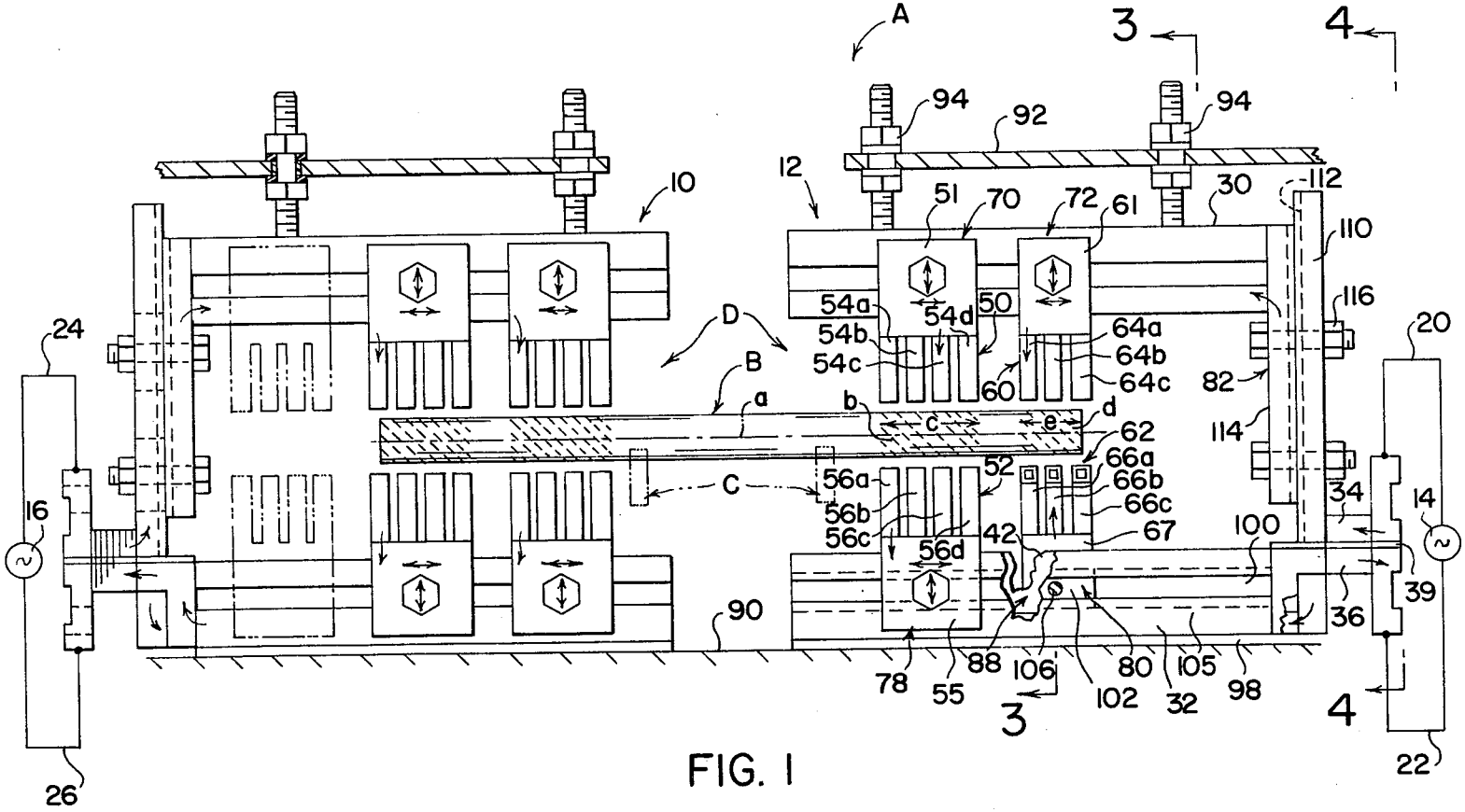
FIG. 1 is a partial front elevational view showing a slot furnace utilizing the inductor assembly arrangement of the present invention.
Figure 2:
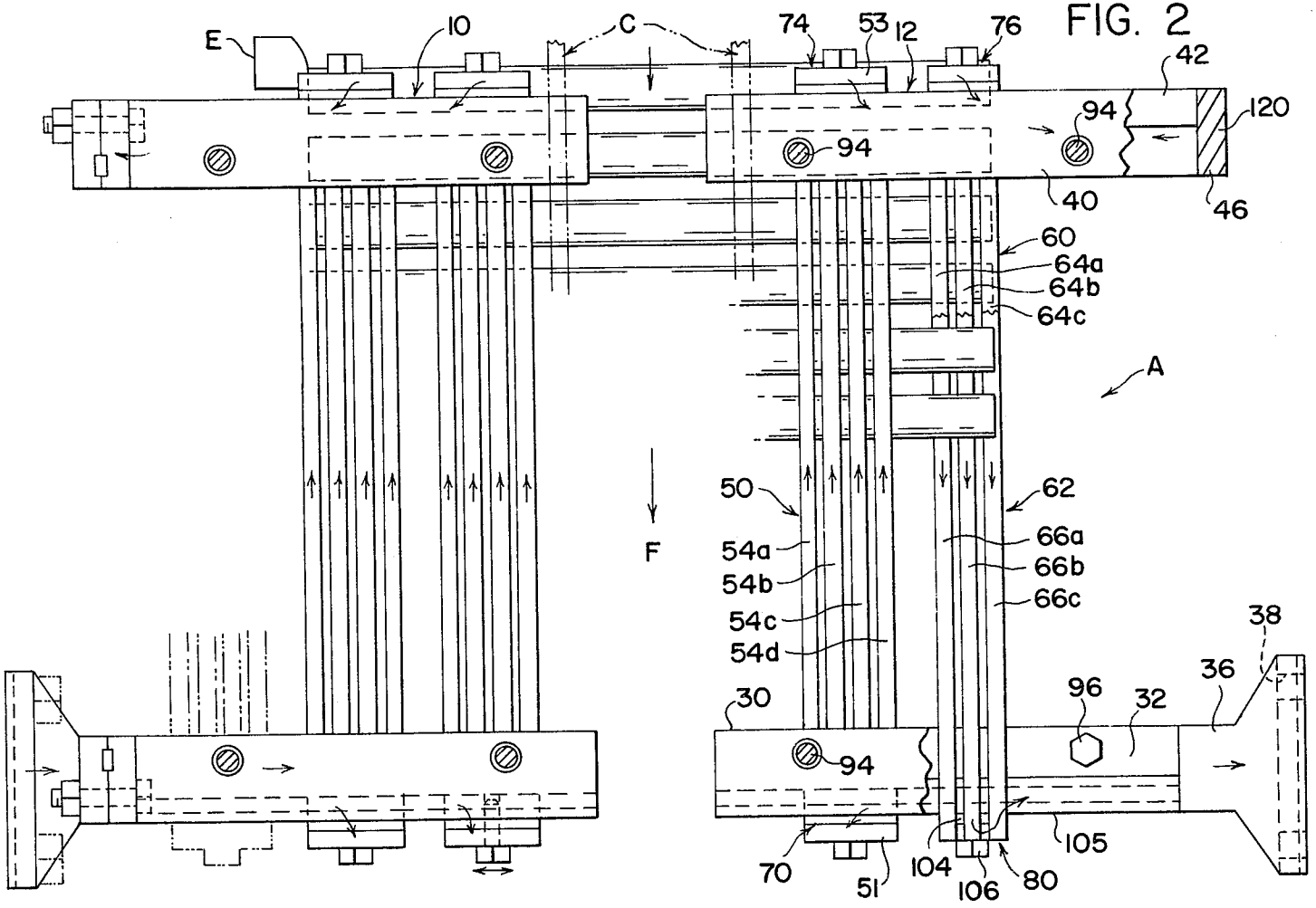
FIG. 2 is a top partially cut away view of the furnace as illustrated in FIG. 1.

Referring now to the drawings wherein the showings are for the purpose of illustrating a preferred embodiment of the invention only, and not for the purpose of limiting same, FIGS. 1–4 show a slot-type induction heating furnace A with the outer housing and insulation removed for the purpose of clarity. The furnace is employed for heating axially spaced areas of a workpiece B having central axis a and movable by a conveyor device C through an area or slot D which is elongated to receive the workpiece and allow conveyance of several workpieces in unison through the slot. The workpieces are moved in unison by conveyor C along a feedline F to a subsequent station. This subsequent station may be a press operation forming the previously heated areas. Conveyor C is shown as moving or indexing nests on two parallel rails. The workpieces are aligned on the rails in an axial direction to assure that the workpieces enter slot D in the same axial position. This alignment is generally controlled by the inlet conveyor or feeding device for feeding the workpieces onto the conveyor device C. Of course a camming block E, shown in FIG. 2, could be used for aligning one end of the workpieces B as they are conveyed into slot D of furnace A. In this arrangement, the workpieces are off-set to the left when entering the furnace so that the camming blocks can align them in an axial direction for proper induction heating. In the illustrated embodiment, conveyor C is located between the areas to be heated and engages the workpieces intermediate the areas to be heated. Other conveying and aligning arrangements could be employed for conveying the workpieces B through slot D along the feedline F which is transverse to the axes a of the individual workpieces B.

In accordance with the preferred embodiment of the present invention, two axially spaced inductor assemblies 10, 12 inductively heat portions of both ends of the workpieces. As previously mentioned, one or both of the inductor assemblies 10, 12 can be used. In accordance with standard practice, each of the inductors is driven by an alternating current power supply, schematically illustrated as generators 14, 16, respectively, connected to input leads 20, 22, and 24, 26, respectively. These power supplies cause alternating current to flow through the inductor assemblies 10, 12 to heat inductively the selected portions of workpieces B, as they pass through slot D. Although not a part of the present invention, assemblies 10, 12 incorporate appropriate passages for allowing flow of coolant liquid through the assemblies in a manner to dissipate accumulated heat energy in the inductor assemblies during use. This is in accordance with standard induction heating technology and practice.

Figure 4:
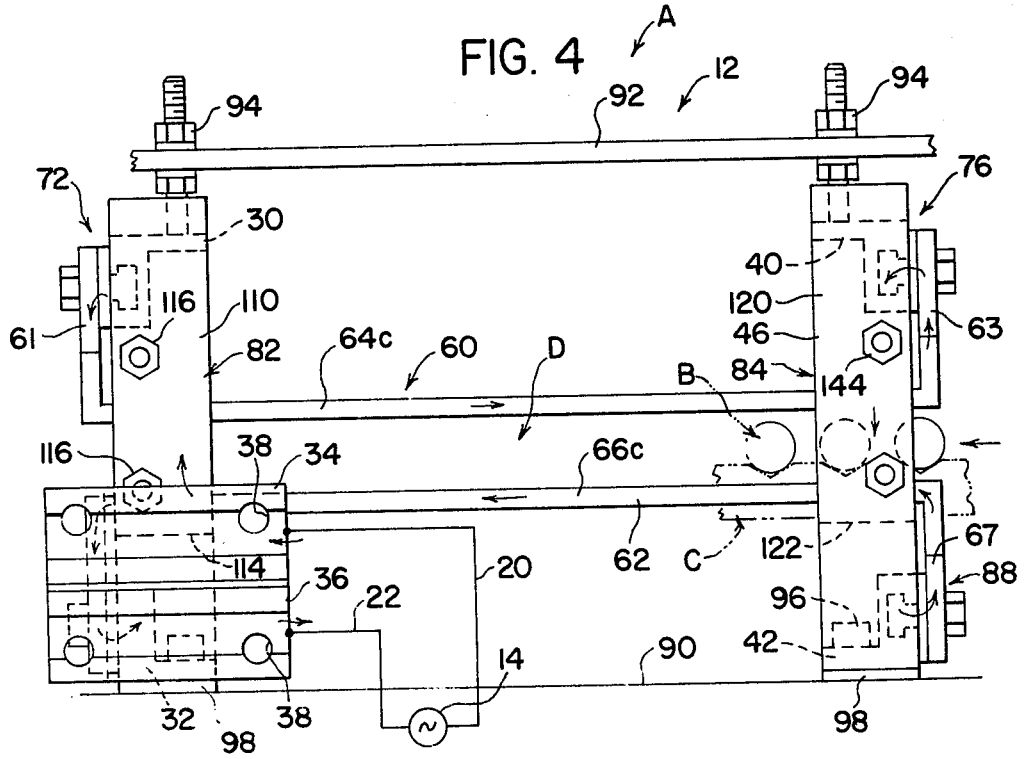
FIG. 4 is an end view taken generally along line 4—4 of FIG. 1; and, FIG. 5 is a schematic wiring diagram illustrating the electrical circuit and adjusting features of the inductor assemblies as employed in the preferred embodiment shown in FIG. 1.

Since each of the inductor assemblies 10, 12 is substantially identical, only inductor assembly 12 will be discussed in detail. This discussion will apply equally to the other inductor assembly 10. Assembly 12 includes upper and lower normally rigid, elongated input members of arms 30, 32 secured onto fixed, rigid input bus 34, 36 respectively, which form the fishtail for input of alternating current from leads 20, 22 to the assembly 12. Appropriate holes 38 as shown in FIG. 4 are used to connect the fishtail to a standard output terminal of an alternating current power supply represented schematically as generator 14 in FIG. 1. Rigid elongated input members of arms 30, 32 are generally paralled to each other and extend transversely over feedline F and on opposite sides of the feedline, which sides are illustrated as upper and lower sides. Thus, the two elongated input members 30, 32 form spaced arms which are connected at the input bus 34, 36 that are generally rigid and separated by an insulating member 39. In a similar manner, upper and lower normally rigid, elongated connecting members or arms 40, 42 are arranged in generally parallel position with respect to input members 30, 32 and at the opposite or entrant end of the furnace A. Normally rigid members 30, 32 and 40, 42 define slot D through which workpieces B pass. To maintain the normal rigidity of members 40, 42, there is provided a connecting arm 46 that is normally rigid, but which can be adjusted in accordance with the invention as will be described later.

To define the fist heating area shown as area b of workpiece B having a length c, there is provided spaced, generally parallel conductor elements or units 50, 52 forming a first pair of such elements or units. The upper conductor unit 50 extends between arms or members 30, 40 and include several subconductors **54*a*–54*d* connected in electrical parallel between end plates 51, 53. Each of these end plates is connected to the spaced arms 30, 40 in a manner to be described later. End plates 51, 53 form current distribution elements for distributing current from the longitudinally spaced members 30, 40 to the parallel subconductors 54*a*–54*d*. In this manner, the subconductors define parallel paths of current flow, which paths, when combined, are wide enough to provide the width c for the heating area b of workpiece B as shown in FIG. 1. In a like manner, the lower conductor element or unit 52 includes spaced end plates or current distributing members 55, 57 between which are extended four parallel subconductors 56*a*–56*d*. In practice, units 50, 52 are spaced above each other in parallel, overlapping relationship on opposite sides of feedline F. Units 50, 52** are employed for heating workpieces B in the area b as the workpieces are conveyed through slot D of furnace A by conveyor device C.

A second pair of conductor elements 60, 62 has the same basic construction as elements 50, 52 except they include only three subelements since the heating area d has a shorter axial length e. In this second pair of elements or conductors, end plates 61, 63 are connected onto spaced arms or members 30, 40 to form current distributing elements to the parallel subconductors 64*a*–64*c*. The conductor unit or element 62 includes spaced end plates or current distributing members 65, 67 which are connected by three electrically parallel subconductors 66*a*–66*c*. Again, units 60, 62 are spaced in overlapping relationship on opposite sides of the workpieces B as they move through the slot of furnace A.

As so far described, the number of pairs of conductor units and the number of parallel subconductors of the units can be changed to control the width and number of heated areas on the right end of workpiece B, as shown in FIG. 1. As shown in the left, three pairs of heating units can be employed with the third pair illustrated in phantom lines. The combined axial width of the subconductors could be varied to also control the width of the heated area. Thus, the individual widths and number of subconductors forming the various pairs of parallel conductor units can be changed without departing from the intended concept of the present invention. As can be seen, the elements 50, 52 and 60, 62 extend in a direction parallel to feedline F and on opposite sides of the slot defined in furnace A.

Figure 3:
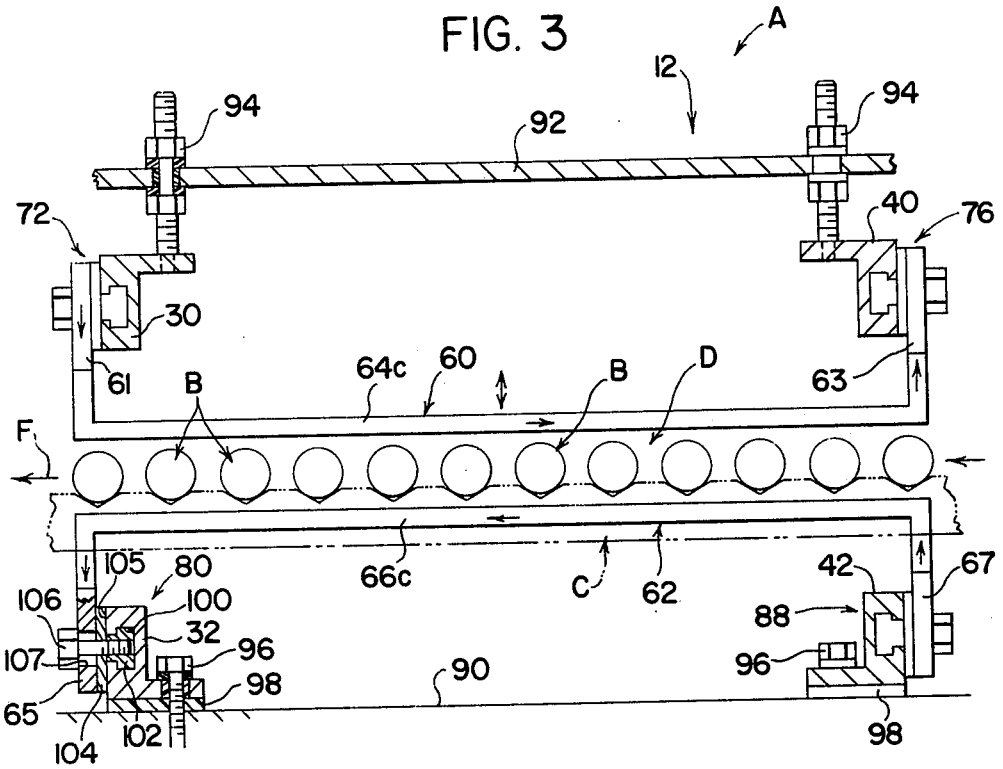
FIG. 3 is a partially cross sectioned view taken generally along line 3—3 of FIG. 1.
Figure 5:
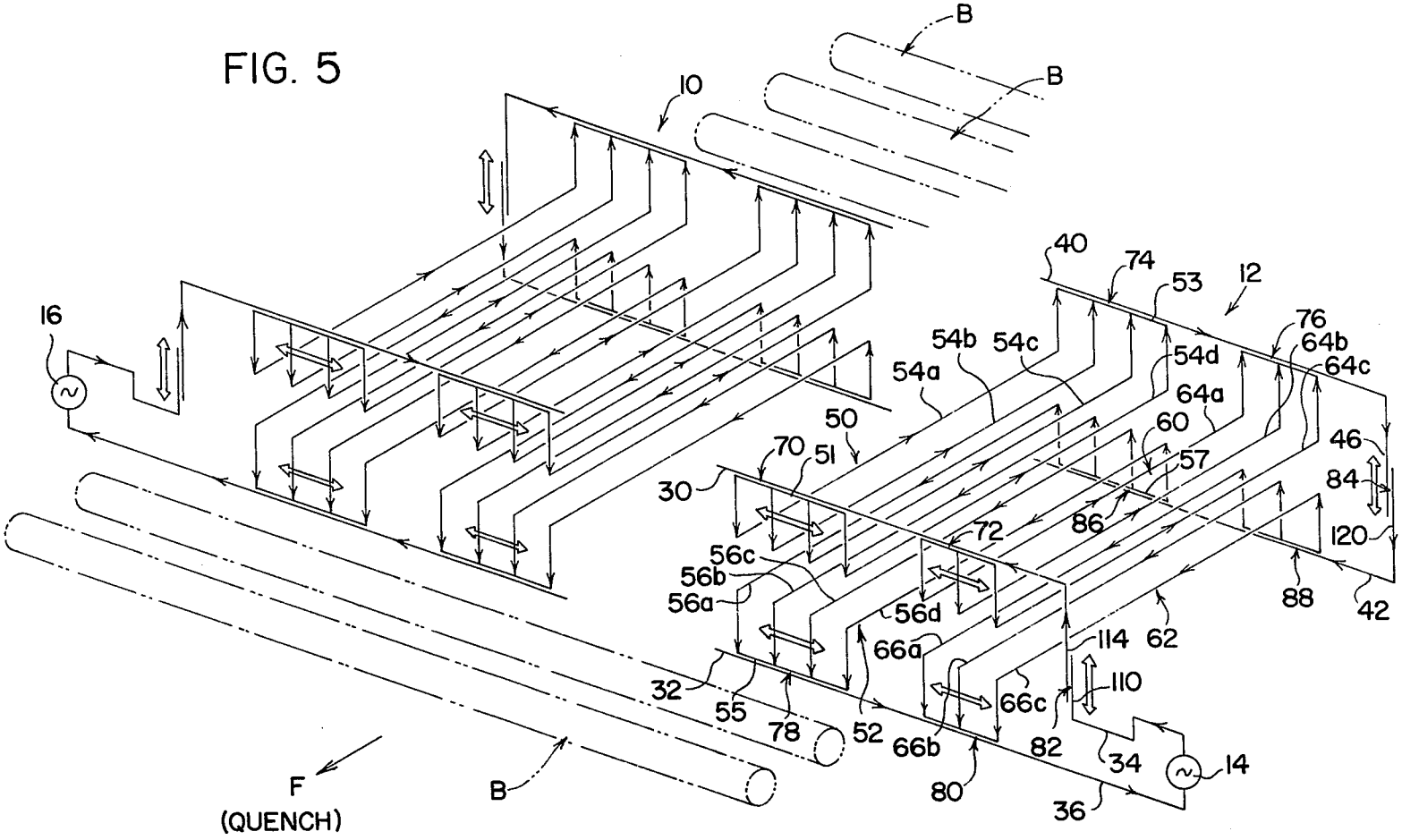

In accordance with the present invention, various coupling connections are incorporated into inductor assembly 12. These connections allow sliding motion and then allow clamping action so that after an adjustment has been made, as will be described later, the assembly 12 is formed into a rigid structure for subsequent use as an inductor assembly. In accordance with the illustrated embodiment of the invention, there are provided several sliding and clamping coupling and connection structures identified as structures 70, 72, 74, 76, 78, 80, 82, 84, 86 and 88. Furnace A is supported on a lower base 90 and includes an upper support plate 92. Hanger bolts 94, which are insulated as shown in FIG. 3, extend vertically to engage arms or members 30, 40 to support the upper portion of assembly 12. Anchor bolts 96 secure arms 32, 42 onto base 90, as best shown in FIG. 3. Of course, anchor bolts 96 may be insulated to combine with an insulation strip 98 for rigid support of lower arms or members 32, 42. Thus, the total assembly 12 is supported at the base and at the top. This prevents unsupporting cantilevering of arms 30, 40. The sliding coupling or connections 70, 72, 74, 76, 78, 80, 86 and 88 are used to slide the conductor units in a direction transverse to feedline F to change the location and spacing, if necessary, between the heated areas of each workpiece B. These couplings or connections incorporated an appropriate structure schematically illustrated in the preferred embodiment at coupling 80 in FIG. 3 as including transversely extending slots 100 in which is slidably received a T cross-sectioned elongated bar 102. This bar reciprocates within slot 100 to allow adjustment. A conductor shim 104 is placed between the end plate or current distributing member 65 and the outer flat surface 105 of arm 32 so that a bolt 106 can clamp the end plate against surface 105 of member 32 after conductor element or unit 62 is shifted into the desired axial position. by loosening bolts 106 at couplings 80, 88, shown in FIG. 3, unit 62 can be moved in an axial direction with respect to workpieces B passing through furnace A. After the unit is in the proper position, bolts 106 are then tightened to clamp the end plates 65, 67 against members 32, 42 in a rigid tight current transmitting relationship. The various elements of inductor assembly 12 through which current flows, as best shown in FIG. 5, are formed from copper or copper base alloys which are well known in the induction heating art and are used conventionally for heating inductors. The other connections at the input arms 30, 32, 40 and 42 are the same as connection 80.

The juction or connection 82 is used to change the vertical spacing of input member 30 with respect to input member 32. This changes the height of slot D by changing the spacing between the various subconductors which form the actual heating elements for the workpieces. Since the subconductors extend downwardly and then in a parallel relationship across the top of the moving workpieces, heating occurs at the innermost portion of these subconductors which are adjacent to the moving workpieces. This allows even distribution of current from the end plate to the parallel subconductors for the actual heating operation. Although a variety of arrangements could be used for adjusting the vertical position of input member 30 with respect to the lower input member 32, the illustrated embodiment shows a rigid beam 110 fixedly secured with respect to input bus 34. A vertically extending slot 112 receives an outwardly extending rib of movable beam 114 to allow vertical sliding of beam 114 with respect to fixed rigid beam 110. Since beam 114 carries upper member 30, adjustment of the movable bean adjusts also the vertical position of member 30. Hanger bolts 94 must also be adjusted in unison with beam 114 to provide the final rigid structure for assembly 12. Bolts 116 are used to lock beams 110, 114 with respect to each other so that the vertical position of member 30 is fixed. Also, this clamping action, which is used in all couplings, is required to prevent a loose sliding connection which could cause arcing and pitting of the adjacent structures during the heating cycle of assembly 12. By loosening bolts 116 and hanger bolts 94, member 30 can be adjusted vertically with respect to the lower fixed member 32. After the adjustment, bolts 116 are tightened to create a clamping action between flat surfaces on these two mutually movable beams for a sound electrical connection. Connecting arm 46 between arms 40, 42 is formed in a manner similar to beams 110, 114. In this instance, beam 120 is fixed to the lower member 42 and the vertically slidable beam 122 carries member 40. Bolts 144 lock these beams together after they have been moved in a vertical direction to correspond with the spacing between members 30, 32.

As schematically illustrated in FIG. 5, the various sliding connections discussed above allow movement of the conductor units arranged in pairs in a direction transverse to feedline F and on the generally parallel longitudinally spaced, normally rigid members 30, 32 and 40, 42. To allow vertical adjustment for different sized workpieces, there are provided couplings or connections 82, 84 as best illustrated in FIG. 5. The current flow through the conductor assembly 12 is shown by the arrows on the various conductor elements shown in FIG. 5. Each of these elements is formed from a copper or copper based material in accordance with normal induction heating practice. The number, width and other dimensions of the various conductor elements defining the spaced heating areas in workpieces B can be changed in accordance with the desired heating pattern for workpieces B as they move in unison through furnace A. In accordance with the illustrated embodiment, an inductor assembly 10 is placed on the end of furnace A opposite to assembly 12. Only one inductor assembly could be used if only one end of the workpiece is to be heated. In practice, both inductor assemblies are employed at opposite sides of the slot furnace. The heating units can be changed in number and size to heat as many areas of the workpieces as will be accommodated by the axial length of arms 30, 32, 40 and 42. If one end of the separate workpieces is not to be heated, the power can be disconnected without removing the support portions of the assembly 10 or 12.

The conductor units can be adjusted individually in a direction perpendicular to feedline F by providing various structures, such as a vertically extending slot 107 in member 65, as shown in FIG. 3. Bolts 106 extend into this slot and allow for vertical adjustment. Of course such adjusting slots are provided at each end of the conductor units and have a length needed for desired adjustment. By this structure, workpiece having different shapes in the heated areas can be heated uniformly by changing the spacing between the aligned conductor unit and a selected portion or area of the workpiece.

Having thus defined the invention, it is claimed:

1. An induction heating inductor for heating first and second axially spaced portions of an elongated workpiece having a central axis and carried by a conveyor along a transversely extending feedline generally perpendicular to said central axis, said inductor comprising: first and second axially spaced pairs of generally straight, parallel conductor elements, said elements in each pair extending generally parallel to said feedline with the first of said conductor elements of each pair being on one side of said feedline and the second of said conductor elements of said pair being on the opposite side of said feedline; means for connecting said elements of each of said pairs in electrical series; means for adjusting the axial spacing between said pairs of conductor elements; said conductor elements each having first and second spaced ends and including a first interconnecting conductor means for electrically connecting said first ends of said first conductor elements of said pairs; second interconnecting conductor means for electrically connecting said first ends of said second conductor elements of said pairs; third interconnecting means for electrically connecting said second ends of said first conductor elements of said pairs; and, fourth interconnecting means for electrically connecting said second ends of said second conductor elements of said pairs wherein said first, second, third and fourth interconnecting means are rigid, generally straight conductors and said first adjusting means includes means for adjusting said conductor elements along said rigid conductors.

2. An induction heating inductorfor heating first and second axially spaced portions of an elongated workpiece having a central axis and carried by a conveyor along a transversely extending feedline generally perpendicular to said central axis, said inductor comprising: first and second axially spaced pairs of generally straight, parallel conductor elements, said elements in each pair extending generally parallel to said feedline with the first of said conductor elements of each pair being on one side of said feedline and the second of said conductor elements of said pair being on the opposite side of said feedline; means for connecting said elements of each of said pairs in electrical series; first means for adjusting the axial spacing between said pairs of conductor elements; second means for adjusting the spacing between the conductor elements in each of said pairs of elements; said conductor elements each having first and second spaced ends and including a first interconnecting conductor means for electrically connecting said first ends of said first conductor elements of said pairs; second interconnecting conductor means for electrically connecting said first ends of said second conductor elements of said pairs; their interconnecting means for electrically connecting said second ends of said first conductor elements of said pairs; and, fourth interconnecting means for electrically connecting said second ends of said second conductor elements of said pairs.

3. An induction heating inductor as defined in claim 2 wherein said second adjusting means includes means for adjusting said first and third interconnecting means with respect to said second and fourth interconnecting means.

4. An induction heating slot furnace including an inductor for heating selected, adjustably spaced first and second axially spaced portions of an elongated workpiece having a central axis, said inductor comprising: first and second generally rigid, elongated input members normally fixed with respect to each other and extending generally parallel to said workpiece axis; means for connecting said input members across a source of alternating current; first elongated conductor means electrically connected between said input members and extending perpendicular to said workpiece axis for inductively heating said first portion of said workpiece; second elongated conductor means electrically connected between said input members and extending perpendicular to said workpiece axis for inductively heating said second portion of said workpiece; and adjustable means for selectively changing the axial spacing between said first and second conductor means to select and adjust said spaced portions.

5. An induction heating inductor as defined in claim 4 including first and second generally, rigid, elongated connecting members, means for electrically connecting said connecting members into an electrical loop having spaced ends and means for connecting said loop into electrical series with both said first and second conductor means at a position intermediate said input members to define two separate spaced portions of said first and second conductor means with said two portions having a normally fixed spacing.

6. An induction heating inductor as defined in claim 5 includng means for selectively changing the normally fixed spacing of said two portions of each of said first and second conductor means.

7. An induction heating inductor for heating an area of an elongated workpiece having an axis and moving in a feedline transverse to said axis, said inductor including first and second normally rigid support conductor elements spaced from each other in the direction of said feedline, each of said conductor elements including a first arm with a first end and located on a first side of said feedline, a second arm with a first end adjacent said first end of said first arm and located on a second side of said feedline, and means for electrically connecting said first and second arms of each conductor element at said first ends; a first elongated conductor unit extending between said first arms of said conductor elements; a second elongated conductor unit extending between said second arms of said conductor elements; first spaced coupling means for coupling said first elongated conductor unit to said first arms; means for allowing adjustment of said first conductor unit with respect to said first ends in a first path generally transverse to said feedline; and second spaced coupling means for coupling said second elongated conductor unit to said second arms; and means for allowing adjustment of said second conductor unit with respect to said first end in a second path parallel to and coextensive with said first path.

8. An induction heating inductor as defined in claim 7 wherein one of said means for electrically connecting includes a portion of electrical separation defining two spaced input leads and means for connecting said leads across a source of alternating current.

* * * * *

UNITED STATES PATENT AND TRADEMARK OFFICE

CERTIFICATE OF CORRECTION

PATENT NO. : 4,258,241

DATED : March 24, 1981

INVENTOR(S) : David R. Soworowski

It is certified that error appears in the above-identified patent and that said Letters Patent are hereby corrected as shown below:

Column 3, line 13, "a" should read -- an --.

Column 4, line 25, "of" should read -- or --, and "bus" should read -- buses --; line 32, "of" should read -- or --; line 37, "bus" should read -- buses --; line 49, "fish" should read -- first --.

Column 5, line 22, "in" should read -- at --; line 58, "incorporated" should read -- incorporate --.

Column 6, line 1, "by" should read -- By --; line 34, "bean" should read -- beam --.

Column 7, line 24, "workpiece" should read -- workpieces --; line 56, delete "first".

Column 8, line 13, "their" should read -- third --; line 43, after "generally" delete the comma (,).

Signed and Sealed this

Thirtieth Day of June 1981

[SEAL]

Attest:

RENE D. TEGTMEYER

Attesting Officer

Acting Commissioner of Patents and Trademarks